United States Patent [19]

Lolley et al.

[11] 4,404,777

[45] Sep. 20, 1983

[54] CONJOINT FACIA, HOOD AND WATER DAM

[75] Inventors: Ted E. Lolley; Randolph W. Driggers, both of Tucker, Ga.

[73] Assignee: MM Systems Corporation, Tucker, Ga.

[21] Appl. No.: 289,086

[22] Filed: Jul. 31, 1981

[51] Int. Cl.[3] ..... F04D 13/15

[52] U.S. Cl. ..... 52/60; 52/94; 52/97

[58] Field of Search ..... 52/94, 58, 60, 96, 400, 52/401, 402, 393, 773, 97; 49/495, 496

[56] References Cited

U.S. PATENT DOCUMENTS

| | | | |
|---|---|---|---|
| 1,870,579 | 3/1931 | Levene | 52/773 X |
| 3,585,766 | 6/1971 | Jamieson | 52/94 X |
| 3,862,531 | 9/1973 | Attaway | 52/300 |
| 4,037,372 | 7/1977 | Patry | 52/96 |
| 4,071,987 | 2/1978 | Hickman | 52/94 |
| 4,241,549 | 12/1980 | Hall et al. | 52/60 |

*Primary Examiner*—John E. Murtagh
*Assistant Examiner*—Kathryn L. Ford
*Attorney, Agent, or Firm*—John B. Armentrout

[57] ABSTRACT

A conjoint facia, hood and water dam is provided having dam and first engagable means affording dam means with ridge structure, and first engagable means. Sheet roofing leading onto the dam means is clamped to the ridge structure by clamp means subsequently to be covered by a facia and hood member, the latter having hood structure and facia means with second engagable means extending from the facia means. The first and second engagable means together form restraining means to be engaged for maintaining the facia means horizontally laterally restrained and the first engagable means includes detaining means for detaining the facia and hood member against upward movement relatively to the dam and first engagable means with the restraining means being engaged. The restraining means are aligned to be engaged after downward movement of the facia and hood member relatively to the dam and first engagable means, against biasing means interposed along with the clamp means between the hood structure of the facia and hood member and the ridge structure of the dam means, and upward movement of the facia and hood member relatively to the dam and first engagable means is detained by the detaining means with the restraining means being engaged, this with the biasing means reactively biasing the facia and hood member to move in an upward direction while the hood structure still covers the ridge structure and the clamp and biasing means.

17 Claims, 12 Drawing Figures

CONJOINT FACIA, HOOD AND WATER DAM

The present invention relates to the architectural field and is more particularly concerned with facia and water dam means for use on buildings and in the environs of a roof deck and an outside wall structure of a building.

An object of this invention is to lend improvements in facia and water dam structure which is to be used as an adjunct to a roof deck and an outside wall of a building.

Another object herein is the provision of a conjoint facia, hood and water dam which is well suited for being commercially produced and offers advantages in and after being installed as an adjunct to the roof deck and an outside wall of a building.

Another object of this invention is to provide a conjoint facia, hood and water dam of the character indicated which conceals resilient biasing means between ridge structure of the dam means and hood structure of facia and hood means, allowing the facia and hood means to be installed, and urging the facia and hood means to remain installed.

A further object herein is that of providing a conjoint facia, hood and water dam of the character indicated, whereby an end portion of sheet roofing extended from a roof deck at the border of the roof deck is held clamped against ridge structure of the dam means, and the clamped end portion of the sheet roofing subsequently is covered by facia and hood means serving as trim frontally of and over the dam means.

Other objects of the present invention in part will be obvious and in part pointed out more fully hereinafter.

As conducive to a clearer understanding of certain features of the present invention, installation of a water dam on a roof deck, which incidentally usually is recognized as being a flat substantially horizontal roof or a roof having a relatively low rake, is favored in the architectural field, thus to control against spill-off of water downwardly along the building wall from the roof deck. In installing a water dam with trim, an end portion of sheet roofing on the roof deck is brought up onto the dam, and it sometimes has become a problem to arrive at, and thereafter maintain, proper placement of the sheet roofing relatively to the dam on the roof deck before the trim is installed and to assure that this placement of the sheet roofing will be preserved throughout installing the trim. Then, too, the types of securements heretofore offered for trim toward maintaining the trim assembled with the dam vary widely, and some of the securements are undesirable such as because of making installation of the trim unduly tedious and time consuming. Certain types of those securements subtract appreciably from neat appearance of the final assembly of the dam and the trim and thus become objectionable for failure to contribute refinement as the installation is viewed.

A further object of this invention accordingly is to provide an easy to install and neat appearing conjoint facia, hood and water dam equipped with resilient clamp means, having counter-active presser means, and the clamp means to be resiliently sprung for clamping the clamp means and the sheet roofing against the dam means toward maintaining a desired position of the sheet roofing relatively to the dam means before and during installation of facia and hood means, and to connect, through a highly satisfactory enabled mode of connection with use of biasing means, the facia and hood means to serve as trim installed concealing the clamp means and the biasing means, still having the sheet roofing clamped in place against the dam means.

Turning to a practice in accordance with the present invention, a conjoint facia, hood and water dam is characterized by including dam and first engagable means wherein dam means, having longitudinal ridge structure with upwardly extending laterally opposite sides, is adapted to face frontally outwardly on a building roof deck, while being adjacent to a wall of the building, to support sheet roofing extended from the roof deck onto the ridge structure. First engagable means, of the dam and first engagable means as installed, occupies a position below the ridge structure of the dam means, and the ridge structure in the installed dam means is supported to stay in a substantially fixed position above the roof deck.

Facia and hood means, also provided in the conjoint facia, hood and water dam, comprises at least one facia and hood member having facia means to be disposed frontally of the dam means and a wall of the building, and hood structure for covering the sheet roofing on the ridge structure of the dam means. Second engagable means in the conjoint facia, hood and water dam extends from the facia means of the facia and hood member, and the first and second engagable means together form restraining means to be engaged for maintaining the facia means horizontally laterally restrained, the first engagable means also including detaining means for detaining the facia and hood member against upward movement relatively to the dam and first engagable means with the restraining means being engaged. In the covering relation of the facia and hood member relatively to the dam means, downwardly extending laterally opposite walls of the hood structure provided by the facia and hood member are disposed laterally outside the upwardly extending laterally opposite sides of the ridge structure of the dam means, having the sheet roofing extend between the ridge structure and the hood structure.

The conjoint facia, hood and water dam still further is inclusive of resilient clamp means to be installed after the dam means, but before the facia and hood means, to maintain the sheet roofing in place against the ridge structure of the dam means. The resilient clamp means comprises counter-active presser means interconnected by bight means, for the clamp means, resiliently sprung, to clamp the sheet roofing, and also self-hold the clamp means, in place against the ridge structure of the dam means, having the counter-active presser means pressing against the upwardly extending laterally opposite sides of the ridge structure. Resilient biasing means also introduced in the conjoint facia, hood and water dam, and used inside the hood structure to act between the hood structure and the ridge structure, biases the facia and hood member to move bodily upward relatively to the dam and first engagable means.

For being installed, the facia and hood member is moved downwardly relatively to the dam and first engagable means, with the hood structure covering the sheet roofing on the ridge structure, the engaged clamp means and the biasing means so as to dispose the downwardly extending laterally opposite walls of the hood structure laterally outside the biasing means, the upwardly extending sides of the ridge structure and the counter-active presser means of the clamp means. The biasing means, situated between the hood structure and the ridge structure, is compressed inside the hood structure during the downward movement of the facia and hood member relatively to the dam and first engagable means, enabling the restraining means to be aligned for being engaged, and the biasing means reactively biases the facia and hood member to move upwardly relatively to the dam and first engagable means and be stopped by the detaining means, with the restraining means meanwhile being engaged and maintaining the facia means horizontally laterally restrained and with the laterally opposite downwardly extending walls of the hood structure still being laterally outside the laterally opposite upwardly extending sides of the ridge structure and the counter-active presser means of the clamp means to prevent horizontal lateral escape of the hood structure.

It will therefore be appreciated that the hood structure of the facia and hood member in and after being installed on the dam means covers the clamp means and the biasing means, with allowance for the sheet roofing to extend between the ridge structure of the dam means, and the clamp means. The hood structure, as initially placed over the ridge structure before compressing the biasing means, preferably is allocated horizontally laterally loosely relatively to the ridge structure by having the downwardly extending laterally opposite walls of the hood structure horizontally laterally loosely spaced outside the installed clamp means, with the hood structure being horizontally laterally further stabilized by the biasing means through subsequently having the biasing means compressed against the ridge structure. It is also preferred, such as under the latter circumstances, to have the hood structure constrain the facia means to press the restraining means laterally together slidably one against the other during the downward movement of the facia and hood member and to snap one off the other into alignment for being engaged, thereby subsequently allowing the facia and hood member under bias of the biasing means to be detained against upward movement, with the restraining means meanwhile being engaged and maintaining the facia means horizontally laterally restrained.

According to certain embodiments of the present invention, which are preferred, a lower rearward inclined side of the dam means deviates from the lower end of the rearward upwardly extending side of the ridge structure of the dam means by extending downwardly and rearwardly toward the roof deck to support sheet roofing having the latter lead from the roof deck and onto the ridge structure. A lowermost rearward portion of the facia and hood member defines a narrowing gap within limits with the sheet roofing on the lower inclined rearward side of the dam means during the downward movement of the facia and hood member, enabling tongue means and grooved means, including the restraining means, to be aligned for being engaged, and the lowermost rearward portion of the facia and hood member defines a widening gap with the sheet roofing on the lower inclined rearward side of the dam means during upward movement of the facia and hood member having the tongue means and the grooved means engaged. In a detained, upwardly biased installed condition of the facia and hood member, the lowermost rearward portion of the facia and hood member accordingly is disposed upwardly away from the sheet roofing on the lower inclined rearward side of the dam means.

In the accompanying drawings wherein several embodiments of the present invention are represented:

Figure 1:
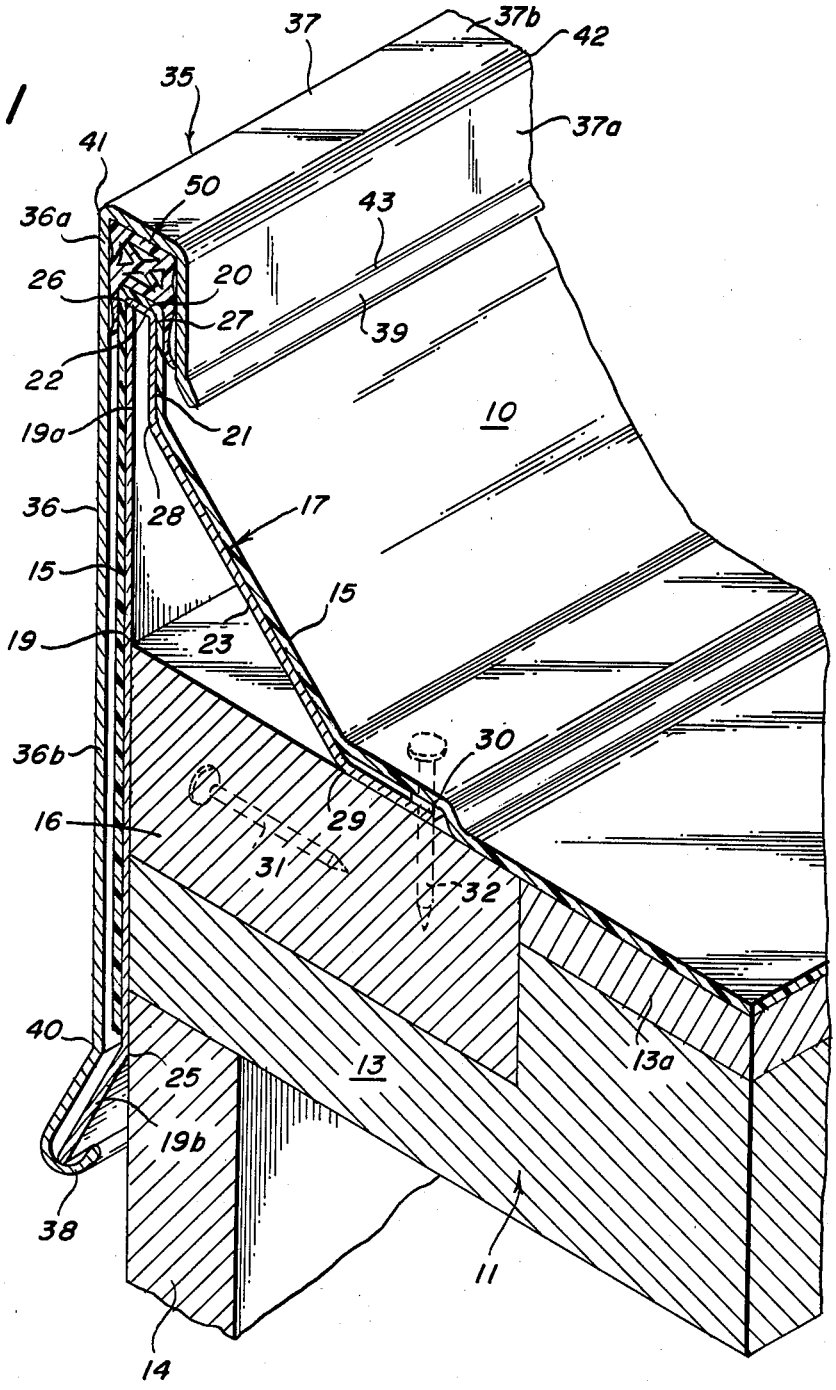
FIG. 1 is a fragmentary isometric view representing a conjoint facia, hood and water dam installed on a roof deck.
Figure 3:
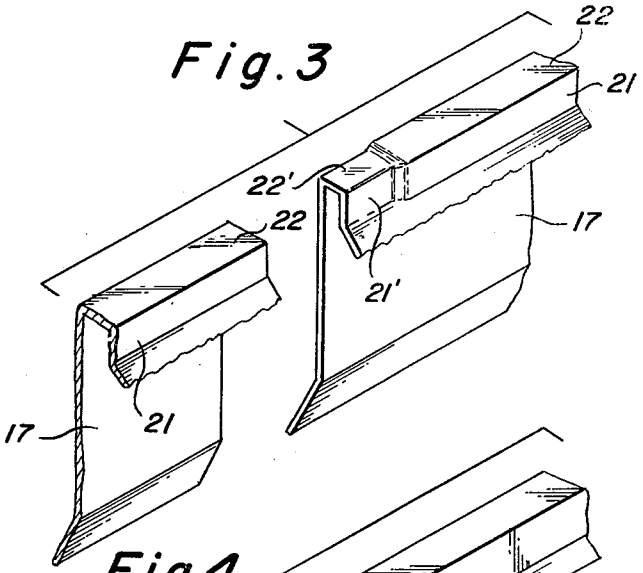
FIG. 3 is an isometric detail focused upon portions of a joint introduced at longitudinal ends of the dam members in FIG. 2.
Figure 4:
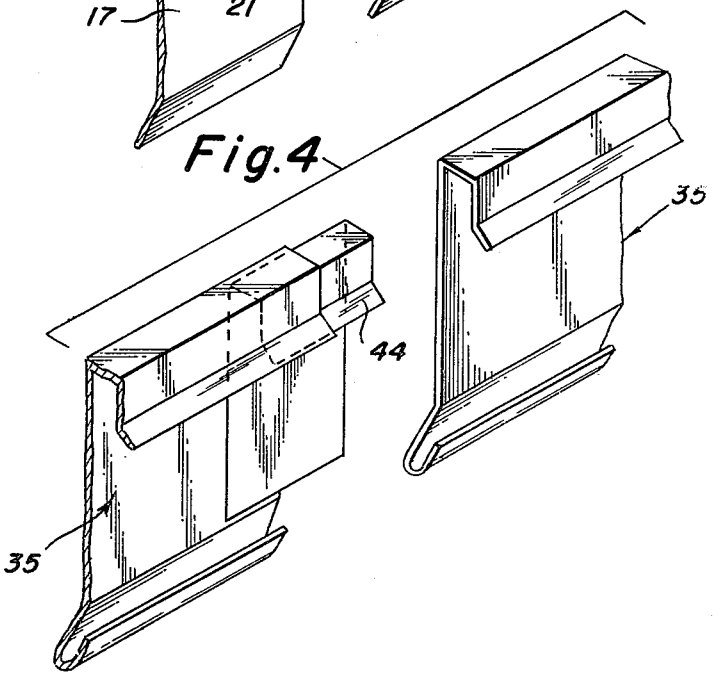
FIG. 4 is an isometric detail of a joint introduced at longitudinal ends of the facia and hood members in FIG. 2.
Figure 2:
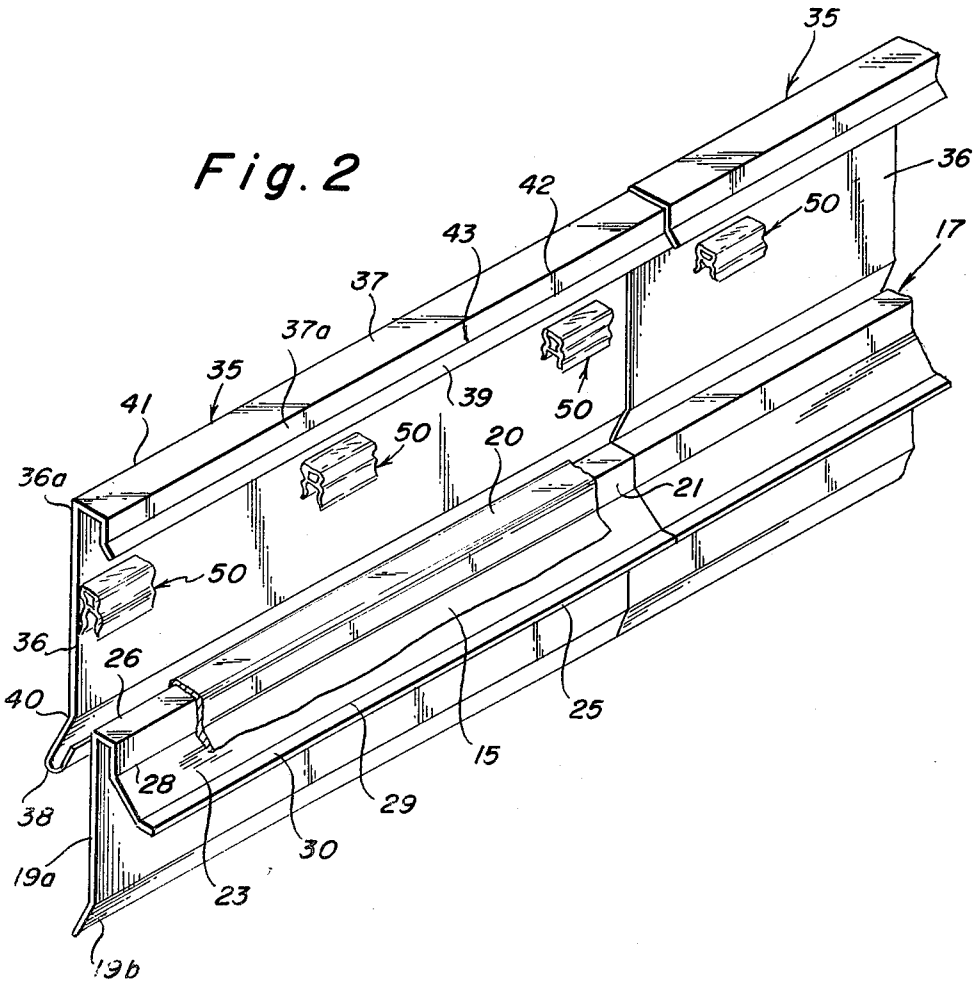
FIG. 2 is an exploded isometric view corresponding to FIG. 1 and represents facia and hood members and dam members along with clamp and biasing units which associate with those members and with sheet roofing.
Figure 5:
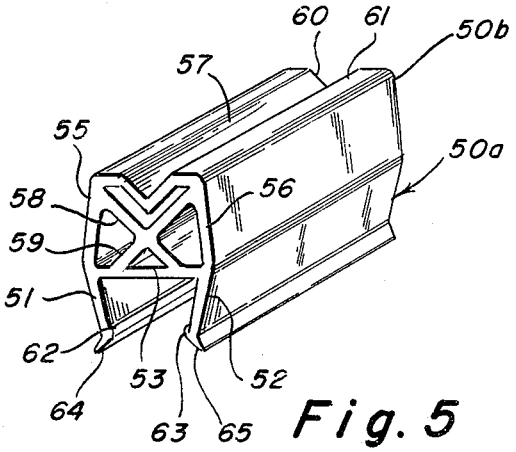
Figure 6:
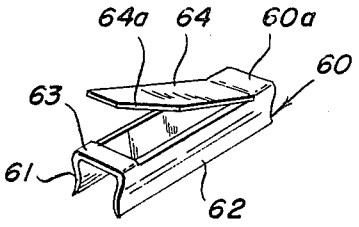
Figure 8:
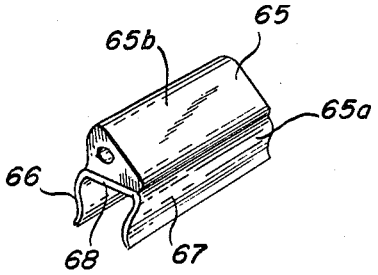
Figure 7:
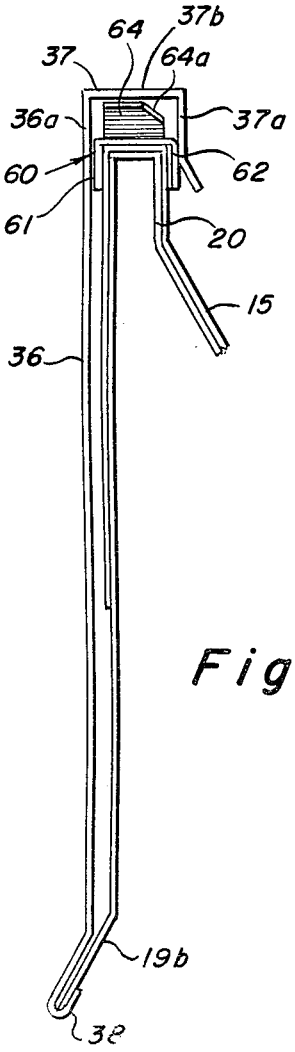
Figure 9:
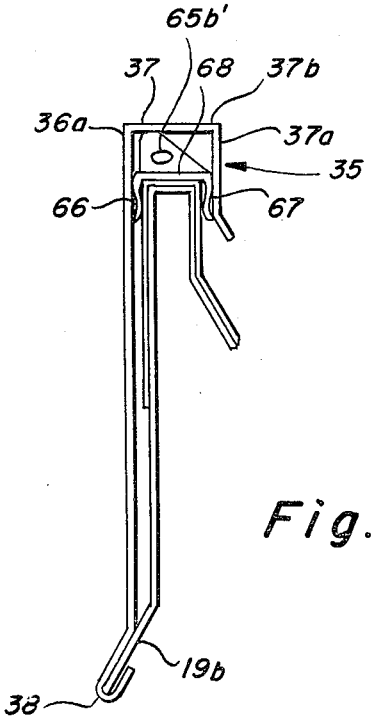
Figure 10:
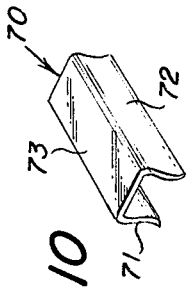
Figure 11:
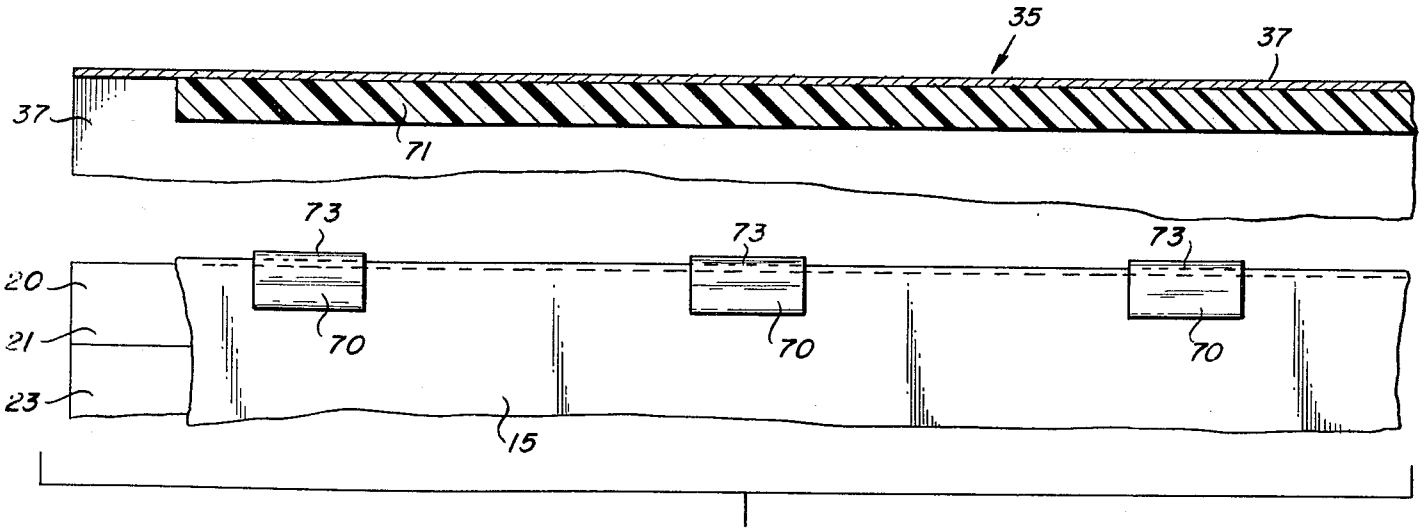
Figure 12:
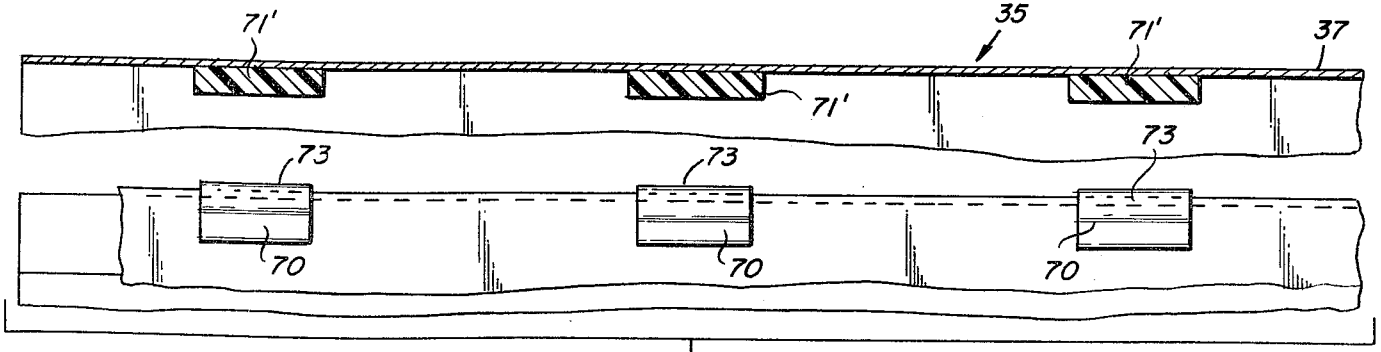

FIG. 5 provides an isometric representation of one of the clamp and biasing units from FIGS. 1 and 2;

FIGS. 6 and 7 respectively represent in isometric a modified form of clamp and biasing unit, and in longitudinal end elevation an installation with the modified clip and biasing unit present;

FIGS. 8 and 9 are views comparable to those provided by the last-mentioned two figures and apply to another modified form of clamp and biasing unit;

FIGS. 10 and 11 represent a further modification, FIG. 10 being an isometric view of one of a plurality of clips accordingly provided, and FIG. 11 being a fragmentary rear elevational view of a facia and hood member, partially in section, ready to be lowered, with biasing means, upon the clips already installed for holding the sheet roofing against the dam means; and FIG. 12 is a view similar to FIG. 11, but introduces a modification of the biasing means used with the clips.

Referring now more particularly to the embodiment of this invention represented in FIGS. 1 to 5 of the accompanying drawings, a pair of dam members 17 similar in transverse cross section (see FIGS. 1 and 2) are installed in longitudinal prolongation of one another on a roof deck 11 of a building, are adjacent to an outside wall 14 of that building and constitute components of a conjoint facia, hood and water dam designated in general by the reference numeral 10 in FIG. 1. Roof deck 11 is a substantially horizontal deck and includes a concrete slab 13 serving as a bed upon which an asphaltic roofing mixture **13*a* has been added as a topping. Securement strip means 16, of wood or of any other suitable material, is fixed at an edge of the roof deck next to the outside wall 14 of the building. The roofing mixture 13*a* is flush with the top side of the securement strip means 16 and is covered at least at the border of the roof deck next to the conjoint facia, hood and water dam 10 by sheet roofing 15, the latter being associated with the dam members 17** in a manner hereinafter more fully to be described.

Each of the dam members 17 is characterized by having a generally vertical front side 19, and longitudinal ridge structure 20 wherein substantially upright forward and rearward laterally opposite sides **19*a* and 21 of the ridge structure are interconnected by a top side 22 of the ridge structure, with the substantially upright forward side 19*a* being a portion of the front side 19 of the dam member 17. The substantially upright rearward side 21 of the ridge structure 20 merges with a lower rearward inclined side 23 of the dam member 17 and the inclined side 23 deviates from the substantially upright rearward side 21 by leading downwardly and rearwardly toward the roof deck 11**.

Depending upon circumstances, only a single dam member 17 instead of two sometimes is used, or more than two such dam members, if need be, are installed in longitudinal prolongation of one another to provide the desired over-all length. In the present embodiment, the dam members 17 are fashioned from sheet material such as of galvanized steel or aluminum base alloy, or are extrusions of any suitable material, and each dam member 17 includes first engagble means integral therewith, suitably in the form of longitudinal lateral tongue means **19*b* projecting outwardly and downwardly laterally of the dam member 17 from an arris 25 which leads longitudinally of the member 17. In certain embodiments of this invention, the longitudinal lateral tongue means 19*b* may be afforded by means separate from the dam means 17 and thus be separately secured to the building. The front side 19, including the substantially upright side 19*a* of the ridge structure 20, is a substantially vertical panel bordered at the arrises 25 and 26 while the top side 22 is a bight wall portion between the arrises 26 and 27. Further, the rearward substantially upright side 21 of the ridge structure 20 is a panel between the arrises 27 and 28, and the lower rearward inclined side 23 is a panel bordered at the arrises 28 and 29 and is integral with connective means, the connective means suitably being in the form of longitudinal lateral flange means 30, resting against the roof deck 11. The arrises 26 and 27 bordering the top side 22 of the ridge structure 20 in each dam member 17 are substantially parallel with one another and with the arrises 25, 28 and 29, extending longitudinally of the dam member 17. The outer edge of the tongue means 19*b* and the outer edge of the longitudinal lateral flange means 30 extend substantially parallel with the arrises 25 and 29 in the dam member 17**.

One of the two adjacent longitudinal ends of the dam member 17 (see FIG. 3) is swaged downward at an end portion 22' of the top side 22 thereof and is swaged forward at an end portion 21' of the substantially upright rearward side 21 thereof to facilitate lapped nesting of these longitudinal end portions of the dam members. The dam members 17 are maintained in place through use of fastening means; suitably headed nails or screws 31 and 32 (see FIG. 1) applied through the front side 19 and through the rear connective means 30 into the aforementioned securement strip means 16 on the roof deck 11, having the front side 19 project downward along the wall 14 of the building.

A plurality of clamp and biasing units 50 are introduced in the conjoint facia, hood and water dam 10, and each of these clamp and biasing units is characterized (see FIG. 5) by including a resilient relatively hard clip member **50*a* wherein counter-active presser means 51 and 52 are interconnected by bight means 53, all in the form of webs which for example are of a hard resilient vinyl material. A resilient relatively soft biasing member 50*b* in the clamp and biasing unit 50 has an outer generally U-shaped shell and an inside X-shaped truss, the shell and the truss being for example of a soft resilient vinyl material. The generally U-shaped shell of the clamp and biasing unit 50 has opposite sides 55 and 56 formed as webs connected at their lower ends with the bight web 53 of the clip member 50*a*, adjacent to junctions of the bight web 53 with the counter-active presser webs 51 and 52 of the clip member 50*a*, and at upper ends the side webs 55 and 56 of the shell of the biasing member 50*b* are interconnected by a centrally longitudinally V-grooved upper web 57 of the shell with the notch being entrant from outside the shell. Webs 58 and 59 of the inside truss are integral at their intersection and define four open passageways, longitudinally through the clamp and biasing unit 50, with the shell of the biasing member 50*b* and the bight wall of the clip member 50*a*. The upper end of truss web 58 has a junction in common with that of the top web 57 of the shell and the side web 55 of the shell, while the lower end of the truss web 58 is connected with bight web 53 of the clip member adjacent to a junction of the bight web 53 of the clip member with the side web 56 of the shell. The upper end of the truss web 59 is in a junction in common with the side web 56 of the shell and the top web 57 of the shell, and the lower end of the truss web 59 is connected with the bight web 53 of the clip member 50*a* adjacent to the junction of the bight web 53 of the clip member with the side web 55** of the shell.

In the relaxed condition of the clip member **50*a*, the presser webs 51 and 52 converge toward one another leading toward their outer free ends. Webs 51 and 52 are provided with heels 62 and 63 for pressing against the sheet roofing 15 after the clip member 50*a* has been resiliently sprung. The outer free ends of the presser webs 51 and 52 beyond the heels 62 and 63 afford end surfaces 64 and 65 which are outwardly flared with reference to one another to facilitate installing the clamp and biasing unit 50**.

When the biasing member **50*b* is relaxed, the side webs 55 and 56 are canted toward one another heading upward from the bight web 53 of the clip member 50*a*. In compressing the biasing member 50*b* downward toward the bight web 53 of the clip member 50*a*, the V-groove formed by web portions 60 and 61 of the shell becomes shallow as the biasing member 50*b* laterally expands, allowing the side webs 55 and 56 to adjust by bowing-in laterally longitudinally centrally toward the intersection of the truss webs 58 and 59—see FIG. 1**.

In certain instances, the clamp and biasing units 50 are products of co-extruding the respective materials introduced, for the resilient clip member **50*a* to be relatively hard and the resilient biasing member 50*b* to be relatively soft as provided ready for use in the conjoint facia, hood and water dam 10**.

The dam members 17 in the conjoint facia, hood and water dam 10 are sheathed frontally and over the ridge structures 20 of the dam members 17 by one or more facia and hood members 35, two such facia and hood members, similar in transverse cross section, being represented in longitudinal end to end relation in FIG. 2 for covering the dam members 17 for a longitudinal extent similar to that of the dam members 17. More particularly, a facia member 36 for each of the facia and hood members 35 has a substantially downright portion **36*a* (see FIG. 1) producing in common a substantially downright forward wall of the hood structure 37 of the facia and hood member 35. A lower substantially downright panel extension 36*b* of the facia member 36 leads downwardly frontally of the dam means and is integral with second engagable means which comprises the grooved means 38. The grooved means 38 is entrant from the rear of the facia member 36 in a downwardly and forwardly inclined direction and provides a downwardly and forwardly inclined drip flange frontally from the lower end of the facia panel extension 36*b* in the installed condition of the facia and hood member 35**.

Hood structure 37 of the facia and hood member also includes a substantially downright rearward wall **37*a* laterally opposite the substantially downright forward wall 36*a* of the hood structure, and these walls are interconnected by a top wall 37*b* serving as a bight member in the hood structure. A lowermost rearward portion 39 of the facia and hood member 35 is integral with the lower end of the substantially downright wall 37***a* at arris 43 and serves as a longitudinal lateral drip flange.

Accordingly, in the facia and hood member 35, the grooved means 38 and the facia member 36 are bordered at a lower arris 40 which is substantially parallel with the arris 43, and also substantially parallel with upper arrises 41 and 42 which border the hood structure top wall 37*b* and respectively the substantially downright forward and rearward walls 36*a* and 37*a* of the hood structure. The outer edge of the lowermost rearward portion 39 of the facia and hood member 35, and the bight portion of the grooved means 38, in the facia and hood member 35, longitudinally lead substantially parallel with the arrises 40, 41, 42 and 43. The facia and hood members 35 are made for example of sheet material such as galvanized sheet steel or aluminum base alloy sheet, whereby components including the facia member 36, hood structure 37, the second engagable means 38 and portion 39 are integral in the facia and hood member. In certain other embodiments in accordance with the present invention, the facia and hood members 35 are extrusions made of any suitable material.

The sheet roofing 15 which is to be associated with a given number of the clamp and biasing units 50 per facia and hood member 35 and thereafter covered by the hood structure 37 of the facia and hood member is extended from the roof deck 11 onto the dam means so as to rest upon the lower rearward inclined side or sides 23, cover the ridge structure or structures 20 and lead down along the front side or sides 19 of the corresponding dam member or members 17. As installed, the given number of clamp and biasing units 50 are spaced apart from one another along a length of row for the clamp and biasing units forming that length of row to support the facia and hood member 35 bodily from underneath the hood structure 37 thereof and clamp the sheet roofing 15 in place against the ridge structure of the dam means. For each of the clamp and biasing units 50 to be installed, the clip member 50*a* of the clamp and biasing unit is resiliently sprung, and the bight web 53 is brought across the top side 22 of the ridge structure and abutted against the sheet roofing 15 on the top side 22, meanwhile having the counter-active presser webs 51 and 52 downwardly directed and actively clamping the sheet roofing against the substantially upright laterally opposite sides 19*a* and 21 of the ridge structure. Under these conditions, the clip member 50*a* not only maintains the sheet roofing in place but also self-holds the clamp and biasing unit 50 in place with the biasing member 50*b* meanwhile being situated in readiness for the corresponding facia and hood member 35 to be installed.

In installing a facia and hood member 35 from over one or more of the dam members 17, as the case may be, after having the clamp and biasing units 50 in place as hereinbefore described, downward and then upward bodily movements of the facia and hood member are brought about having the substantially downright laterally opposite walls 36*a* and 37*a* of the hood structure 37 of that member remain laterally outside the substantially upright sides 19*a* and 21 of the related one or more of the dam members 17 and laterally outside the clip members 50*a* of the clamp and biasing units corresponding to the facia and hood member being moved downwardly and then upwardly. The hood structure 37, during these downward and upward movements, is horizontally laterally allocated within limits defined by the substantially downright walls 36*a* and 37*a* of the hood structure relatively to the clip members 50*a* which are under the hood structure 37 and are arranged for holding the sheet roofing 15 against the dam means. The limits on allocation of the hood structure 37 horizontally laterally preferably tolerate looseness horizontally laterally between the substantially downright laterally opposite walls 36*a* and 37*a* and the clip members 50*a*, to facilitate the downward and upward movements of the facia and hood member 35 and to alleviate drag upon the clip members 50*a*. In the downward movement of the facia and hood member 35, which is promoted by external force applied to the facia and hood member, the biasing members 50*b* of the clamp and biasing units 50 are compressed against the under face of the top wall 37*b* of the facia and hood member and against the bight webs 53 of the clip members 50*a*, having the bight webs 53 abutted against the top side 22 of the ridge structure through the sheet roofing 15.

A gap formed by the lowermost rearward portion 39 of the facia and hood member with the sheet roofing 15 on the lower rearward inclined side 23 of the related dam member or members 17, narrows within limits during the downward movement of the facia and hood member, enabling the grooved means 38 and the tongue means 19*b* to be aligned for being engaged, and this same extent of downward movement is tolerated compressively by the biasing members 50*b* of the clamp and biasing units 50 under the hood structure 37 of the facia and hood member 35. Upward movement of the facia and hood member 35 bodily is thereafter promoted by the reactive biasing effect of the compressed biasing members 50*b* underneath the hood structure 37 of the facia and hood member, and the upward movement is accompanied by a widening of the gap between the lowermost rearward portion 39 and the sheet roofing 15 on the lower rearward inclined side 23 of the related one or more of the dam members 17, with the tongue means 19*b* and the grooved means 38 meanwhile being engaged. Notably, the tongue means 19*b* leads into the grooved means 38 in a downward and outward direction and therefore includes a vertical reach, and the engaged tongue means 19*b* and grooved means 38 accordingly interlock to maintain the facia means 36 in a horizontally laterally restrained condition. Eventually, the upward movement of the facia and hood member 35 is detained by the end of the tongue means 19*b* which is contacted by the bight portion of the grooved means 38. Thereafter, the biasing members 50*b* under the hood structure 37 of the facia and hood member 35 continue to bias the facia and hood member in an upward direction having the lowermost rearward portion 39 clear of the sheet roofing 15 on the lower rearward inclined side 23 of the related dam member or members 17.

Horizontal lateral allocation of the hood structure 37, assured within limits by the substantially downright laterally opposite walls 36*a* and 37*a* of the hood structure being laterally outside the related clip members 50*a* on the ridge structure of the dam means, is supplemented by a horizontal lateral stabilizing effect of the compressed biasing members 50*b* upon the hood structure 37. This horizontal lateral stabilizing effect of the compressed biasing members 50*b* endures during the downward and upward movements of the facia and hood member 35 and after the facia and hood member has been installed and this stabilization meanwhile is accompanied by having the substantially downright laterally opposite walls 36*a* and 37*a* of the hood structure be laterally outside the related clip members 50*a* on the ridge structure of the dam means. The engaged grooved means 38 and tongue means 19*b*, moreover, lock the facia member 36 against being freed horizontally laterally during and after the upward movement of the facia and hood member 35. Notably, too, after the facia and hood member 35 has been installed, the hood structure 37 conceals and protects the clamp and biasing units 50 which support the facia and hood member having the latter detained as hereinbefore set forth and still biased upwardly by the compressed biasing members 50*b*.

The downward thrusts of the compressed biasing members 50*b* are applied to the bight webs 53 of the compressed biasing members 50*b* in favor of urging the clip members 50*a* to remain in place upon the ridge structure 20 of the related dam member or members 17 during the downward and then upward movements of the facia and hood member 35 and after the upward movement of the facia and hood member has been stopped by the detaining means. The hood structure 37, as supported on the compressed biasing members 50*b*, and as allocated by the substantially downright laterally opposite walls 36*a* and 37*a* with reference to the related ridge structure 20, constrains the facia member 36 during the downward movement of the facia and hood member 35 to press the grooved means 38 and the tongue means 19*b* laterally together to slide one relatively to the other until snap acting one off the other into alignment for being engaged, upon the ensuing upward movement of the facia and hood member 35.

According to the present embodiment, adjacent longitudinal ends of several facia and hood members 35 are spliced from the inside, using a splice member 44 (see FIG. 4) which is made of sheet material such as galvanized steel or aluminum base alloy. The splice member 44 is lapped against the two facia and hood members 35 longitudinally of the latter, to bridge the joint from inside and substantially close a gap between the adjacent ends of those facia and hood members, thus allowing for expansion and contraction. One of the two facia and hood members 35 is for example first installed in a manner hereinbefore described, and prior to installing the second of the two facia and hood members 35, the second facia and hood member 35 is pre-assembled with the splice member 44 in a lapped relation. A portion of the splice member 44 projecting from the second facia and hood member 35 is inserted under the adjacent end of the already installed facia and hood member 35 and the second facia and hood member 35 thereafter is installed in a manner hereinbefore described.

Modified clamp and biasing units 60, one of which is represented in FIG. 6, are instead sometimes availed upon for use, in accordance with the present invention, in the conjoint facia, hood and water dam 10 in a manner similar to that hereinbefore described with reference to the clamp and biasing units 50. Each unit 60, made for example of stainless steel, is characterized by including a resilient clip member 60*a* with counter-active pressure webs 61 and 62 interconnected by a bight web 63 from which a resilient arm 64 has been struck to provide a biasing member. Arm 64, in the installed clamp and biasing unit 60, projects above the plane of the bight web 63 leading longitudinally of that bight web and the ridge structure 20 (see FIG. 7) having the clip member 60*a* resiliently sprung to clamp the unit 60 and the sheet roofing 15 against the ridge structure 20. An outer end portion 64*a* of the resilient arm 64 is beveled along the laterally rearward edge so as to concentrate upward reactive thrust application of the arm 64 against the inner face of top wall 37*b* of the hood structure to be more proximate to the facia 36 than to the substantially downright rearward wall 37*a* and thus reduce thrust eccentricity relatively to the engaged grooved means 38 and tongue means 19*b*.

In a further embodiment of this invention, somewhat similar to that just described, a plurality of clamp and biasing units 65 (see FIG. 8 for one such unit) are instead provided in the conjoint facia, hood and water dam 10 as the clamp and biasing means. The clamp and biasing units 65 are each comprised of a clip member 65*a* including counter-active presser webs 66 and 67 interconnected by a bight web 68 all made for example of stainless steel or of a hard resilient vinyl material for the clip member to be resiliently sprung and installed in a manner hereinbefore described. The bight web 68 carries securely on the top side thereof a resilient biasing member 65*b* made of any suitable material such as soft vinyl. A hollow 65*b*′ longitudinally through the biasing member 65*b* allows for compression and the biasing member 65*b* is laterally inclined forwardly upwardly at rearward face to provide a longitudinal crest which is to be in closer proximity to the facia 36 (see FIG. 9) than to the rearward wall 37*a* of the related facia and hood member 35 to press reactively upwardly against the top wall 37*b* of the hood structure 37 and thereby reduce thrust eccentricity relatively to the engaged grooved means 38 and tongue means 19*b*.

In another embodiment in accordance with the present invention, a plurality of discrete resilient clips 70 (see FIGS. 10 and 11) each having counter-active presser webs 71 and 72, interconnected by a bight web 73, are introduced spaced apart from one another longitudinally of the ridge structure 20 and are resiliently sprung for clamping the sheet roofing 15 against the ridge structure while the clips 70 are self-held against the sheet roofing 15 and the laterally opposite substantially upright sides 19*a* and 21 of the ridge structure. Resilient biasing strip means 71, such as of open cell foam elastomeric material, is disposed inside the hood structure 37 of a related facia and hood member 35 and is secured to the hood structure 37 beforehand for later being installed with the facia and hood member, thus to be abutted reactively against the hood structure 37 and bias the facia and hood member 35 upwardly when the biasing strip means is compressed against the bight webs 73 of the already installed clips 70. The biasing strip means 71 longitudinally substantially coextends with the hood structure 37 for a distance which at least accounts for having the resilient strip means 71 press portions thereof downwardly upon the bight webs 73 of the clips 70 which are covered by the hood structure 37 of the facia and hood member 35. In other embodiments, still in accordance with this invention, the biasing means (see FIG. 12) instead may for example include a plurality of discrete elastomeric open cell foam strip units 71′ inside the hood structure 37 of the facia and hood member 35, and secured spaced apart from one another longitudinally of the hood structure beforehand, later to be installed with the facia and hood member 35 in order to contact the bight webs 73 of the clips 70 and be compressed.

As the invention lends itself to many possible embodiments and as many possible changes may be made in the embodiments hereinbefore set forth, it will be distinctly understood that all matter described herein is to be interpreted as illustrative and not as a limitation.

We claim:

1. In a conjoint facia, hood and water dam, the combination which includes; dam and first engagable means comprising, dam means having longitudinal ridge structure which includes upwardly extending laterally opposite forward and rearward sides, and said dam means adapted to be on a roof deck of a building and installed adjacent to a wall of said building for sustaining said ridge structure in a substantially fixed position above said roof deck and supporting sheet roofing having the latter lead from said roof deck at the rear of said dam means onto said ridge structure, and first engagable means adapted to be in a position adjacent to said building wall and below said ridge structure; facia and hood means comprising at least one facia and hood member, said facia and hood member including hood structure for covering said sheet roofing on said ridge structure and said hood structure comprising downwardly extending forward and rearward laterally opposite walls, and facia means to be disposed frontally of said dam means and said wall of said building and said facia means having second engagable means, said first and second engagable means together including restraining means to be engaged by upward movement of said facia and hood member for maintaining said facia means horizontally laterally restrained and said first engagable means comprising means for detaining said facia and hood member against movement in an upward direction relatively to said dam and first engagable means; and clamp and biasing means including resilient clamp means comprising counter-active presser means and bight means interconnecting said counter-active presser means, for said counter-active presser means, with said bight means disposed across said ridge structure and said clamp means resiliently sprung, to hold said clamp means clamped against said sheet roofing on said ridge structure and against said upwardly extending laterally opposite sides of said ridge structure having said sheet roofing disposed between said clamp means and said ridge structure, and resilient biasing means for being inside said hood structure to abut against said hood structure and be pressed downwardly against said clamp means while said sheet roofing is clamped by said clamp means against said ridge structure having said bight means disposed across said ridge structure and said sheet roofing disposed between said clamp means and said ridge structure; said facia and hood member, to be installed, initially having said hood structure covering said clamp and biasing means, and said sheet roofing clamped by said clamp means against said ridge structure, with said bight means being disposed across said ridge structure and said sheet roofing being disposed between said clamp means and said ridge structure and said downwardly extending walls of said hood structure being laterally outside said upwardly extending laterally opposite sides of said ridge structure, and said facia and hood member thereafter being downwardly moved relatively to said dam and first engagable means for said restraining means to be aligned for being engaged having said resilient biasing means inside said hood structure and pressed downwardly against said clamp means and urging said clamp means to remain in place with said bight means disposed across said ridge structure and said clamp means clamping said sheet roofing against said ridge structure and said sheet roofing being disposed between said clamp means and said ridge structure and having said biasing means reactively move said facia and hood member upward relative to said dam and first engagable means to engage said restraining means and have said upward movement of said facia and hood member be stopped by said detaining means, with said restraining means thereafter still being engaged and said biasing means still pressing said clamp means downwardly and resiliently urging said facia and hood member in an upward direction, and with said hood structure still covering said sheet roofing on said ridge structure and said laterally opposite downwardly extending walls of said hood structure still being laterally outside said upwardly extending laterally opposite sides of said ridge structure and said clamp and biasing means.

2. In a conjoint facia, hood and water dam as set forth in claim 1, wherein said clamp and biasing means comprises a plurality of resilient clips, each including counter-active presser means and bight means interconnecting said counter-active presser means, for said clips to be disposed resiliently sprung spaced apart from one another longitudinally along said ridge structure under said hood structure of said facia and hood member having said bight means of said clips across said ridge structure and said counter-active presser means of said clips holding said clips in place against said sheet roofing and said laterally opposite upwardly extending sides of said ridge structure, and said biasing means includes a plurality of resilient biasing portions to be pressed downwardly abutted against said clips under said hood structure of said facia and hood member and reactively to bias said facia and hood member bodily upwardly during said downward and upward movements of said facia and hood member and after said facia and hood member has been stopped against said upward movement by said detaining means with said restraining means being engaged.

3. In a conjoint facia, hood and water dam as set forth in claim 2, wherein said resilient biasing portions of said resilient biasing means are supported by said bight means of clips to press said clips downwardly and reactively bias said facia and hood member bodily upwardly during said downward and upward movements of said facia and hood member and after said facia and hood member has been stopped against said upward movement by said detaining means with said restraining means being engaged.

4. In a conjoint facia, hood and water dam as set forth in claim 2, wherein a plurality of discrete clip and biasing units, for being installed upon said ridge structure prior to installing said facia and hood member, include said clips and said resilient biasing portions connected with said clips for said resilient biasing portions to be pressed downwardly against said clips and reactively bias said facia and hood member bodily upwardly during said downward and upward movements of said facia and hood member and after said facia and hood member has been stopped against said upward movement by said detaining means with said restraining means being engaged.

5. In a conjoint facia, hood and water dam as set forth in claim 2, wherein a plurality of discrete resilient clip and biasing units, for being installed upon said ridge structure prior to installing said facia and hood member, include said resilient biasing portions on said bight means of said clips and connected with said bight means of said clips to press said clips downwardly and reactively bias said facia and hood member bodily upwardly during said downward and upward movements of said facia and hood member and after said facia and hood member has been stopped against said upward movement by said detaining means with said restraining means being engaged.

6. In a conjoint facia, hood and water dam as set forth in claim 5, wherein said resilient biasing portions are elastomeric members resting upon said bight means of said clips and projecting above said bight means of said clips.

7. In a conjoint facia, hood and water dam as set forth in claim 5, wherein said resilient biasing portions are resilient arms struck from said bight means of said clips and said resilient arms project above said bight means of said clips.

8. In a conjoint facia, hood and water dam as set forth in claim 6, wherein said resilient clip and biasing units are products of co-extrusion of materials thereof, said material of said clips being relatively hard and said material of said biasing members being relatively soft in said products as used.

9. In a conjoint facia, hood and water dam as set forth in claim 2, wherein said resilient biasing means is securely inside said hood structure prior to installing said facia and hood member, for said resilient biasing portions to be superimposed upon said clips on said ridge structure so as to press downwardly against said clips in installing said facia and hood member and reactively bias said facia and hood member bodily upwardly during said downward and upward movements of said facia and hood member and after said facia and hood member has been stopped against said upward movement by said detaining means with said restraining means being engaged.

10. In a conjoint facia, hood and water dam as set forth in claim 9, wherein said resilient biasing portions are portions of strip means substantially continuously longitudinally extending with said hood structure of said facia and hood member inside said hood structure for a distance sufficient to present said biasing portions to said clips.

11. In conjoint facia, hood and water dam as set forth in claim 1, wherein said hood structure is allocated horizontally laterally relatively to said ridge structure by said downwardly extending laterally opposite walls of said hood structure being laterally outside said clamp means and is horizontally laterally stabilized by said pressed biasing means during said downward movement of said facia and hood member, to constrain said facia means to press said restraining means to snap into alignment for being engaged.

12. In a conjoint facia, hood and water dam as set forth in claim 11, wherein said hood structure of said facia and hood member is loosely allocated horizontally laterally relatively to said ridge structure by said downwardly extending laterally opposite walls of said hood structure being horizontally laterally loosely outside said clamp means to facilitate said downward and upward movements of said facia and hood member, and said hood structure is horizontally laterally stabilized by said biasing means during said downward and upward movements of said facia and hood member and after said facia and hood member has been stopped against said upward movement by said detaining means with said restraining means being engaged.

13. In a conjoint facia, hood and water dam, the combination which includes; dam and first engagable means comprising, dam means including, longitudinal ridge structure having upwardly extending laterally opposite forward and rearward sides, and a lower rearward inclined side of said dam means to deviate downwardly and rearwardly from a lower end of said upwardly extending rearward side of said ridge structure toward a roof deck of a building, and said dam means adapted to be on said roof deck and installed adjacent to a wall of said building for sustaining said ridge structure in a substantially fixed position above said roof deck and supporting sheet roofing having the latter lead from said roof deck at the rear of said dam means onto said lower rearward inclined side of said dam means and said ridge structure, and first engagable means adapted to be in a position adjacent to said building wall and below said ridge structure; facia and hood means comprising at least one facia and hood member, said facia and hood member including hood structure for covering said sheet roofing on said ridge structure and comprising downwardly extending forward and rearward laterally opposite walls, and facia means having second engagable means, said first and second engagable means together including tongue means and grooved means for said tongue means and said grooved means to be engaged and said first engagable means comprising detaining means for stopping movement of said facia and hood member in an upward direction relatively to said dam and first engagable means, said tongue means to be received leading in a direction which intersects with horizontal into said grooved means during upward movement of said facia and hood member, to engage said tongue means and said grooved means laterally interlockingly and maintain said facia means horizontally laterally restrained; and clamp and biasing means including resilient clamp means comprising counter-active presser means and bight means interconnecting said counter-active presser means, for said counter-active presser means, with said bight means disposed across said ridge structure and said clamp means resiliently sprung, to hold said clamp means clamped against said sheet roofing and against said upwardly extending laterally opposite forward and rearward sides of said ridge structure with said sheet roofing being disposed between said clamp means and said ridge structure, and resilient biasing means for being pressed downwardly inside said hood structure against said clamp means to urge said clamp means to remain in place and to bias said facia and hood member to move upwardly relatively to said dam and first engagable means; said facia and hood member, to be installed, being downwardly and then upwardly moved relatively to said dam and first engagable means with said hood structure covering said sheet roofing on said ridge structure and disposing said downwardly extending laterally opposite walls of said hood structure laterally outside said upwardly extending sides of said ridge structure and laterally outside said clamp and biasing means, a lowermost rearward portion of said facia and hood member defining a gap narrowing within limits with said sheet roofing on said lower inclined rearward side of said dam means during said downward movement of said facia and hood member, enabling said tongue means and said grooved means to be aligned for being engaged, and said lowermost rearward portion of said facia and hood member defining a widening gap with said sheet roofing on said lower inclined rearward side of said dam means during said upward movement of said facia and hood member with said tongue and grooved means engaged, and said biasing means acting inside said hood structure upwardly against said hood structure and downwardly against said clamp means on said ridge structure with said sheet roofing being disposed between said clamp means and said ridge structure for said downward movement of said facia and hood member to be against bias of said biasing means and said upward movement of said facia and hood member to be under bias of said biasing means, having said biasing means urging said clamp means to remain in place, and said upward movement of said facia and hood member being stopped by said detaining means thereafter having said lowermost rearward portion of said facia and hood member clear of said sheet roofing on said lower inclined rearward side of said dam means, and said facia and hood member still biased in an upward direction by said biasing means and said clamp means still pressed downwardly on said ridge structure by said biasing means with said hood structure still covering said sheet roofing on said ridge structure and said downwardly extending laterally opposite forward and rearward walls of said hood structure still laterally outside said upwardly extending laterally opposite forward and rearward sides of said ridge structure and said clamp and biasing means.

14. In a conjoint facia, hood and water dam as set forth in claim 13, wherein said hood structure of said facia and hood member is allocated horizontally laterally relatively to said ridge structure by said downwardly extending laterally opposite walls of said hood structure being horizontally laterally outside said clamp means and said hood structure is horizontally laterally stabilized by said pressed biasing means during said downward movement of said facia and hood member, to constrain said facia means to press said grooved means and said tongue means laterally together slidably one against the other and to snap one off the other into alignment for being engaged, and said grooved means and said tongue means thereafter are engaged as a result of said upward movement of said facia and hood member.

15. In a conjoint facia, hood and water dam as set forth in claim 14, wherein said clamp and biasing means comprises a plurality of resilient clips, each including counter-active presser means and bight means interconnecting said counter-active presser means, for said clips to be disposed resiliently sprung spaced apart from one another longitudinally along said ridge structure under said hood structure of said facia and hood member having said bight means of said clips across said ridge structure and said counter-active presser means of said clips holding said clips in place against said sheet roofing and said laterally opposite upwardly extending sides of said ridge structure, and said biasing means includes a plurality of resilient biasing portions to be pressed downwardly against said clips under said hood structure of said facia and hood member and reactively to bias said facia and hood member bodily upwardly during said downward and upward movements of said facia and hood member and after said upward movement of said facia and hood member has been stopped by said detaining means.

16. In a conjoint facia, hood and water dam as set forth in claim 15, wherein a plurality of discrete resilient clip and biasing units, for being installed upon said ridge structure prior to installing said facia and hood member, include said resilient biasing portions connected with said clips to press said clips downwardly against said ridge structure and reactively bias said facia and hood member bodily upwardly during said downward and upward movements of said facia and hood member and after said upward movement of said facia and hood member has been stopped by said detaining means.

17. In a conjoint facia, hood and water dam as set forth in claim 15, wherein said hood structure carries said resilient biasing means securely inside said hood structure and said clips are to be on said ridge structure prior to installing said facia and hood member, for said resilient biasing portions to be superimposed upon said clips on said ridge structure so as to press said clips downwardly and reactively bias said facia and hood member bodily upwardly during said downward and upward movements of said facia and hood member and after said upward movement of said facia and hood member has been stopped by said detaining means.

* * * * *